US009102176B2

(12) United States Patent
Kanzawa et al.

(10) Patent No.: US 9,102,176 B2
(45) Date of Patent: Aug. 11, 2015

(54) IMAGE FORMING APPARATUS, IMAGE FORMING METHOD, AND NON-TRANSITORY COMPUTER-READABLE STORAGE MEDIUM

(71) Applicants: Tomokazu Kanzawa, Kanagawa (JP); Suguru Yokozawa, Kanagawa (JP)

(72) Inventors: Tomokazu Kanzawa, Kanagawa (JP); Suguru Yokozawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 83 days.

(21) Appl. No.: 14/086,762

(22) Filed: Nov. 21, 2013

(65) Prior Publication Data

US 2014/0139848 A1 May 22, 2014

(30) Foreign Application Priority Data

Nov. 22, 2012 (JP) ..... 2012-256852
Sep. 20, 2013 (JP) ..... 2013-195950

(51) Int. Cl.

| | |
|---|---|
| ***B41J 29/393*** | (2006.01) |
| ***B41J 19/14*** | (2006.01) |
| ***B41J 19/20*** | (2006.01) |
| ***B41J 23/02*** | (2006.01) |

(52) U.S. Cl.

CPC ..... *B41J 19/142* (2013.01); *B41J 19/202* (2013.01); *B41J 23/02* (2013.01)

(58) Field of Classification Search

None

See application file for complete search history.

(56) References Cited

U.S. PATENT DOCUMENTS

| | | | | |
|---|---|---|---|---|
| 7,377,605 | B2 * | 5/2008 | Loyer et al. | 347/9 |
| 7,771,000 | B2 * | 8/2010 | Iesaki | 347/19 |
| 7,832,824 | B1 * | 11/2010 | Erdtmann et al. | 347/14 |
| 2009/0237744 | A1 | 9/2009 | Ogura et al. | |

FOREIGN PATENT DOCUMENTS

| | | |
|---|---|---|
| JP | 2006-240026 | 9/2006 |
| JP | 2009-029037 | 2/2009 |

* cited by examiner

*Primary Examiner* — Lamson Nguyen

(74) *Attorney, Agent, or Firm* — Duft Bornsen & Fettig LLP

(57) ABSTRACT

According to an embodiment, an image forming apparatus includes: a carriage, on which a recording head is mounted, to be driven by a driving source to reciprocate; and a drive control unit that controls driving of the driving source by PWM control. The drive control unit includes a detecting unit that detects at least any one of a position and a velocity of the carriage, a calculating unit that calculates PWM command values from detection results output from the detecting unit, a storing unit that stores a maximum value and a minimum value of the PWM command values, a comparing unit that compares a difference between the maximum value and the minimum value against a predetermined threshold value, and a stop-output command unit that, when the difference between the maximum value and the minimum value exceeds the threshold value, outputs a command to stop driving of the carriage.

12 Claims, 18 Drawing Sheets

FIG.6

| PWM COMMAND VALUE | EQUIVQLENT VOLTAGE | DUTY RATIO |
|---|---|---|
| 4000 | +24 V | +100% |
| 2000 | 0 V | 50% |
| 0 | -24 V | 0% |

IMAGE FORMING APPARATUS, IMAGE FORMING METHOD, AND NON-TRANSITORY COMPUTER-READABLE STORAGE MEDIUM

CROSS-REFERENCE TO RELATED APPLICATIONS

The present application claims priority to and incorporates by reference the entire contents of Japanese Patent Application No. 2012-256852 filed in Japan on Nov. 22, 2012 and Japanese Patent Application No. 2013-195950 filed in Japan on Sep. 20, 2013.

BACKGROUND OF THE INVENTION

1. Field of the Invention

The present invention relates to an image forming apparatus, an image forming method, and a non-transitory computer-readable storage medium.

2. Description of the Related Art

Liquid ejection recording that uses a recording head, e.g., a liquid ejection head (liquid-droplet ejection head) that ejects liquid droplets, is commonly employed in image forming apparatuses such as printing machines, facsimile machines, copying machines, plotting machines, and multifunction peripherals having two or more functions of these machines. Known examples of such an imaging forming apparatus include inkjet recording apparatuses.

In an image forming apparatus that forms an image using a recording head mounted on a carriage driven to reciprocate, it is necessary to stop the moving carriage immediately upon occurrence of an abnormal condition, such as contact between the carriage and paper (hereinafter, "paper floating") elastically bent in a manner to bulge toward the carriage or a foreign matter unintentionally entered the apparatus.

Under the circumstance, there is a conventionally known technique for driving a carriage by performing operations including: obtaining position/velocity information about the carriage using a linear encoder while calculating position/velocity command values; feeding back the values and the information; determining a drive condition of the carriage based on a difference between the position/velocity command values and current position/velocity values of the carriage; and stopping the carriage when the difference exceeds a permitted value. An example of this technique is disclosed in Japanese Laid-open Patent Application No. 2006-240026.

However, an image forming apparatus that applies high driving power onto a carriage or includes a carriage whose weight is large can encounter a situation where a position/velocity of the carriage remains unchanged even when contact between the carriage that is moving and floating paper or a foreign matter occurs.

In such a situation, the configuration disclosed in Japanese Laid-open Patent Application No. 2006-240026 disadvantageously fails to immediately stop the carriage, causing an ejection surface of a recording head and/or the carriage to be damaged.

Therefore, it is desirable to provide an image forming apparatus that allows immediate detection of contact between a carriage that is moving and paper or a foreign matter and, upon detection, stopping the carriage.

SUMMARY OF THE INVENTION

It is an object of the present invention to at least partially solve the problems in the conventional technology.

According to an aspect of the present invention, there is provided an image forming apparatus including: a carriage including a recording head mounted thereon, the carriage being to be driven by a driving source to reciprocate; and a drive control unit that controls driving of the driving source by PWM control, wherein the drive control unit includes: a detecting unit that detects at least any one of a position and a velocity of the carriage; a calculating unit that calculates PWM command values from detection results output from the detecting unit; a storing unit that stores a maximum value and a minimum value of the PWM command values calculated by the calculating unit; a comparing unit that compares a difference between the maximum value and the minimum value of the PWM command values against a predetermined threshold value; and a stop-output command unit that, when a result of comparison made by the comparing unit is that the difference between the maximum value and the minimum value of the PWM command values exceeds the threshold value, outputs a command to stop driving of the carriage.

According to another aspect of the present invention, there is provided an image forming method for forming an image by controlling driving of a driving source of a carriage by PWM control, the carriage including a recording head mounted thereon and being to be driven to reciprocate by the driving source, the image forming method including: detecting at least any one of a position and a velocity of the carriage; calculating PWM command values from results of the detecting; storing a maximum value and a minimum value of the calculated PWM command values; comparing a difference between the maximum value and the minimum value of the PWM command values against a predetermined threshold value; and outputting a command to stop driving of the carriage when a result of the comparing is that the difference between the maximum value and the minimum value of the PWM command values exceeds the threshold value.

According to still another aspect of the present invention, there is provided A non-transitory computer-readable storage medium having computer readable program codes, performed by an image forming apparatus that includes a carriage including a recording head mounted thereon, the carriage being to be driven by a driving source to reciprocate and a drive control unit that controls driving of the driving source by PWM control, the program codes when executed causing the image forming apparatus to execute: detecting at least any one of a position and a velocity of the carriage; calculating PWM command values from results of the detecting; storing a maximum value and a minimum value of the calculated PWM command values; comparing a difference between the maximum value and the minimum value of the PWM command values against a predetermined threshold value; and outputting a command to stop driving of the carriage when a result of the comparing is that the difference between the maximum value and the minimum value of the PWM command values exceeds the threshold value.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 6 is an explanatory diagram for describing an example of relation between PWM command values and voltages;

DETAILED DESCRIPTION OF THE PREFERRED EMBODIMENTS

Figure 1:
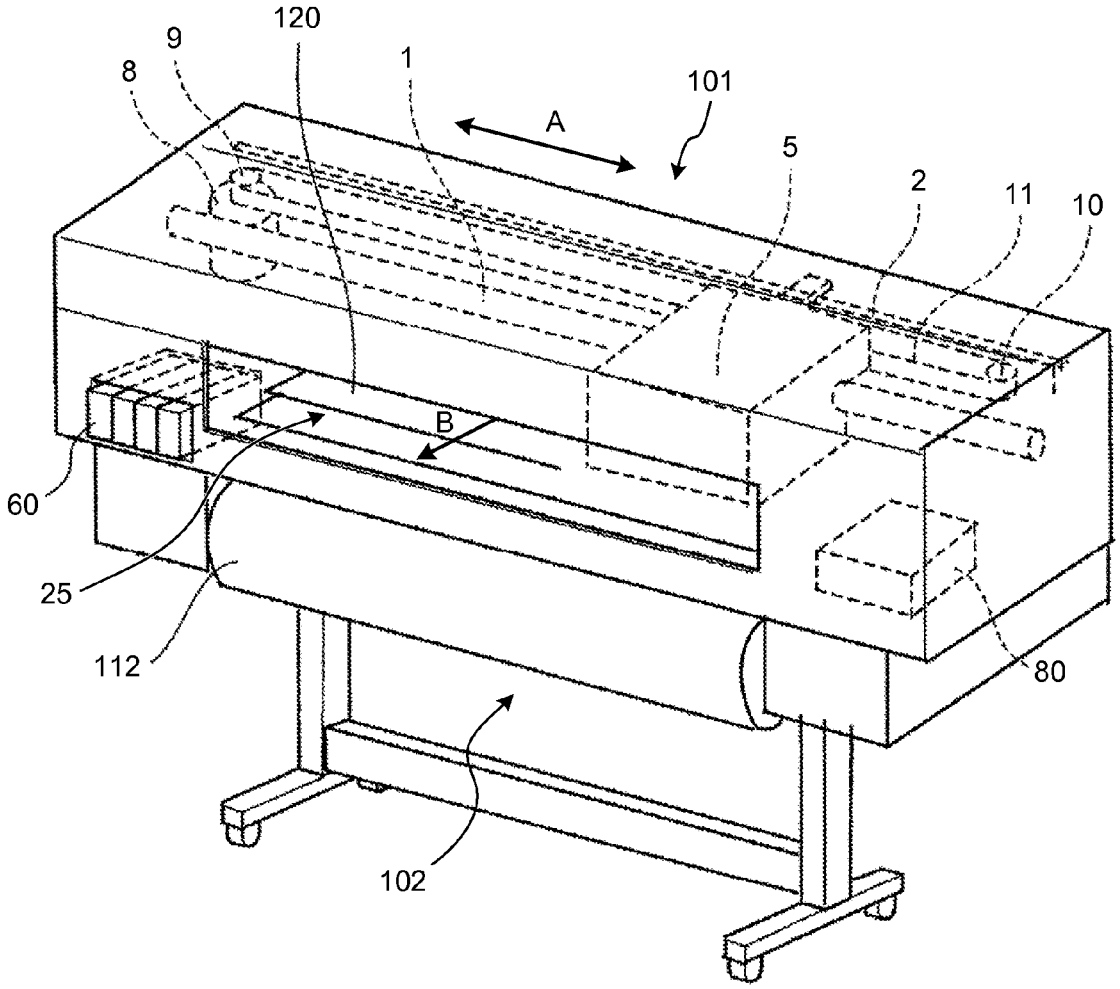
FIG. 1 is an explanatory perspective exterior view of an example of an image forming apparatus according to an embodiment of the present invention.
Figure 2:
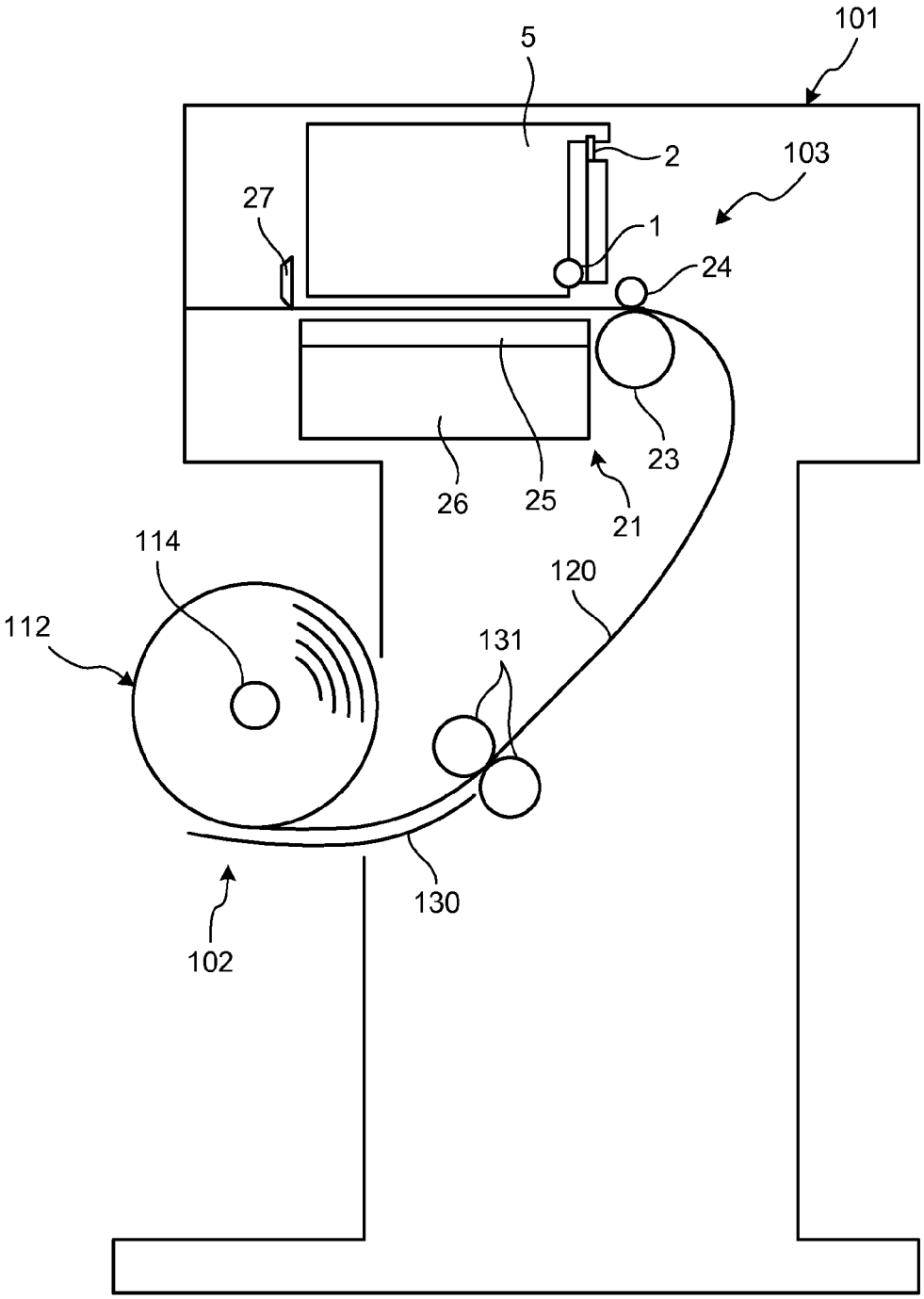
FIG. 2 is an explanatory side schematic of the apparatus.
Figure 3:
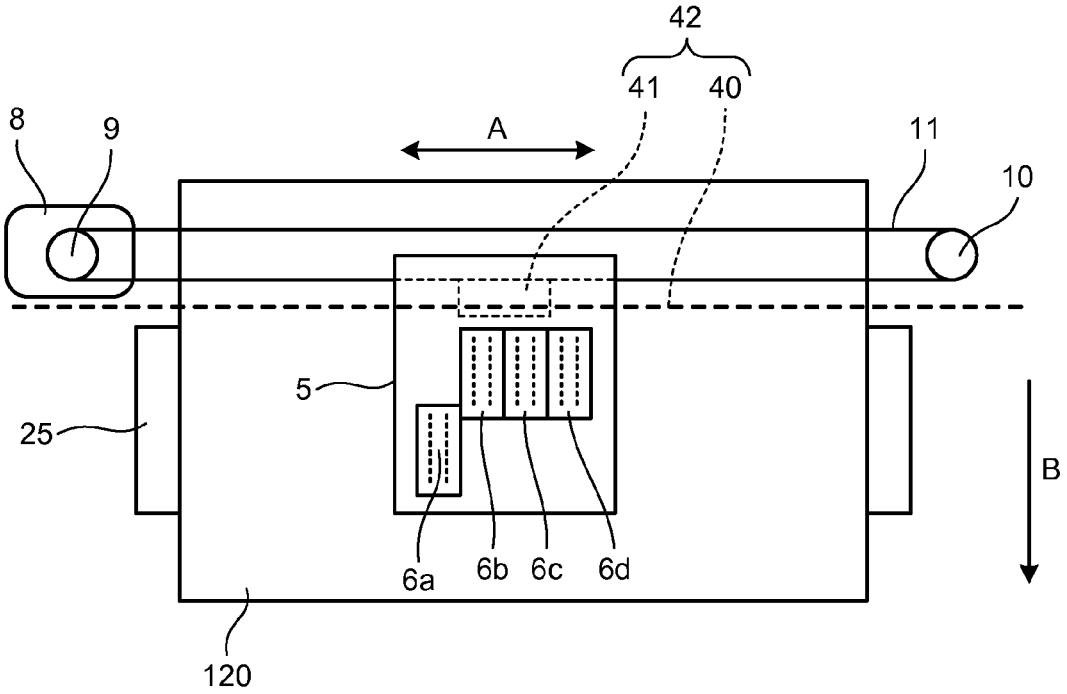
FIG. 3 is an explanatory plan view of a relevant portion of an image forming unit of the apparatus.

Exemplary embodiments of the present invention are described below with reference to the accompanying drawings. An example of an image forming apparatus according to embodiments of the present invention is described below with reference to FIGS. 1 to 3. FIG. 1 is an explanatory perspective exterior view of the image forming apparatus. FIG. 2 is an explanatory side schematic of the apparatus. FIG. 3 is an explanatory plan view of a relevant portion of an image forming unit of the apparatus.

The image forming apparatus is a serial image forming apparatus and includes an apparatus body 101 and a paper feeding device 102 arranged below the apparatus body 101. The paper feeding device 102 is arranged below the apparatus body 101 independent thereof; however, in FIG. 2, the paper feeding device 102 is depicted as being integral with the apparatus body 101 for convenience.

An image forming unit 103 is arranged in the apparatus body 101. The image forming unit 103 is the image forming unit that forms an image on roll paper 120, which is a roll-type medium, fed from the paper feeding device 102.

The image forming unit 103 is configured as follows: a guide rod 1 and a guide stay 2, which are guide members, are laid across between facing side plates (not shown); a carriage 5 is supported by the guide rod 1 and the guide stay 2 to be movable in a direction indicated by arrow A (in other words, the main-scanning direction or the carriage-moving direction).

A main-scanning motor 8, which is a driving source that causes the carriage 5 to reciprocate, is arranged on one side in the main-scanning direction. A timing belt 11 is supported by and stretched between and around a driving pulley 9 and a driven pulley 10 arranged on a side opposite to the driving pulley 9 in the main-scanning direction. The driving pulley 9 is driven to rotate by the main-scanning motor 8. A belt holding unit (not shown) of the carriage 5 is fixed to the timing belt 11. Driving the main-scanning motor 8 causes the carriage 5 to reciprocate in the main-scanning direction.

Mounted on the carriage 5 are a plurality of (in this example, four) recording heads 6*a* to 6*d* (referred to as "the recording heads 6" when no distinction is necessary). Each recording head 6 includes a liquid ejection head and a head tank for supplying liquid to the head formed integrally in one piece.

The recording head 6*a* is out of flush with the recording heads 6*b* to 6*d* in a sub-scanning direction, which is perpendicular to the main-scanning direction, by a single head (i.e., a single nozzle array). Mounted on the recording head 6 are nozzle arrays made up of a plurality of droplet-ejection nozzles arranged in the sub-scanning direction, which is perpendicular to the main-scanning direction, and oriented to eject droplets downward.

Each of the recording heads 6*a* to 6*d* has two nozzle arrays. The recording heads 6*a* and 6*b* eject droplets of a same color, black (Bk), from any one of the nozzle arrays. The recording head 6*c* ejects cyan (C) droplets from one of the nozzle arrays, but leaves the other nozzle array as an unused nozzle array. The recording head 6*d* ejects yellow (Y) droplets from one of the nozzle arrays, and ejects magenta (M) droplets from the other nozzle array.

With this configuration, a monochrome image can be formed using the recording heads 6*a* and 6*b* line by line; each line having the width of the two heads is formed by a single scanning motion (main scanning motion). A color image can be formed using, for example, the recording heads 6*b* to 6*d*. The configuration of the heads is not limited to that described above; alternatively, all of the plurality of recording heads may be arranged to be flush with one another in the main-scanning direction.

Ink of the respective colors is supplied to the head tanks of the recording heads 6 via supply tubes from ink cartridges 60, which are main tanks, replaceably attached to the apparatus body 101.

An encoder sheet 40 is arranged along the moving direction of the carriage 5. The carriage 5 includes an encoder sensor 41 for reading the encoder sheet 40. The encoder sheet 40 and the encoder sensor 41 make up a linear encoder 42. A position and a velocity of the carriage 5 are detected based on output signals of the linear encoder 42.

Meanwhile, the roll paper 120 is fed from the paper feeding device 102 to a recording area, which is a part of a main-scanning area of the carriage 5, and intermittently conveyed by a conveying unit 21 in the direction (in other words, the sub-scanning direction, the paper conveying direction, or the direction indicated by arrow B) perpendicular to the main-scanning direction of the carriage 5.

The conveying unit 21 includes a conveying roller 23 and a pressing roller 24, which are arranged to face each other, for conveying the roll paper 120, which is a roll-type medium, fed from the paper feeding device 102. The conveying unit 21 further includes, on a side downstream of the conveying roller 23, a conveyance guide member 25, in which a plurality of suction holes are defined, and a suction fan 26 functioning as a suction unit that performs suction through the suction holes in the conveyance guide member 25.

As illustrated in FIG. 2, a cutter 27 functioning as a cutting unit that cuts the roll paper 120, on which an image is formed by the recording heads 6, to a desired length is arranged downstream of the conveying unit 21.

In addition, a maintenance/recovery mechanism 80 that performs maintenance and recovery of the recording heads 6 is arranged on one side in the main-scanning direction of the carriage 5 at a position lateral to the conveyance guide member 25.

The paper feeding device 102 contains a media roll 112. The media roll 112 is formed by winding the sheet (referred to as "roll paper" as already described above) 120, which is an elongated roll-type medium, around a tube 114, which is a core member.

In the embodiment, the media roll 112 to be loaded on the apparatus can be either a fixed type, in which a trailing end of the roll paper 120 is bonded to the tube 114 with an adhesive or the like, or a not-fixed type, in which the trailing end of the roll paper 120 is not bonded to the tube 114 with an adhesive or the like.

Arranged in the apparatus body 101 are a guide member 130 that guides the roll paper 120 drawn out from the media roll 112 of the paper feeding device 102 and a pair of conveying rollers 131 that delivers the roll paper 120 upward while elastically bending the roll paper 120.

When the pair of conveying rollers 131 is driven to rotate, the roll paper 120 is drawn out from the media roll 112. The roll paper 120 is conveyed in a state of being stretched between the pair of conveying rollers 131 and the media roll 112. The roll paper 120 passes through between the pair of conveying rollers 131 to be fed to a nip between the conveying roller 23 and the pressing roller 24 of the conveying unit 21.

In the image forming apparatus configured as described above, the carriage 5 is moved in the main-scanning direction. The roll paper 120 delivered from the paper feeding device 102 is intermittently fed by the conveying unit 21. The recording heads 6 are driven to eject droplets according to image data (print data), whereby a desired image is formed on the roll paper 120. The roll paper 120, on which the image is formed, is cut to a desired length by the cutter 27 and guided by a paper-output guide member (not shown) arranged on a front surface side of the apparatus body 101 to be discharged into a bucket (not shown) to be housed therein.

Figure 4:
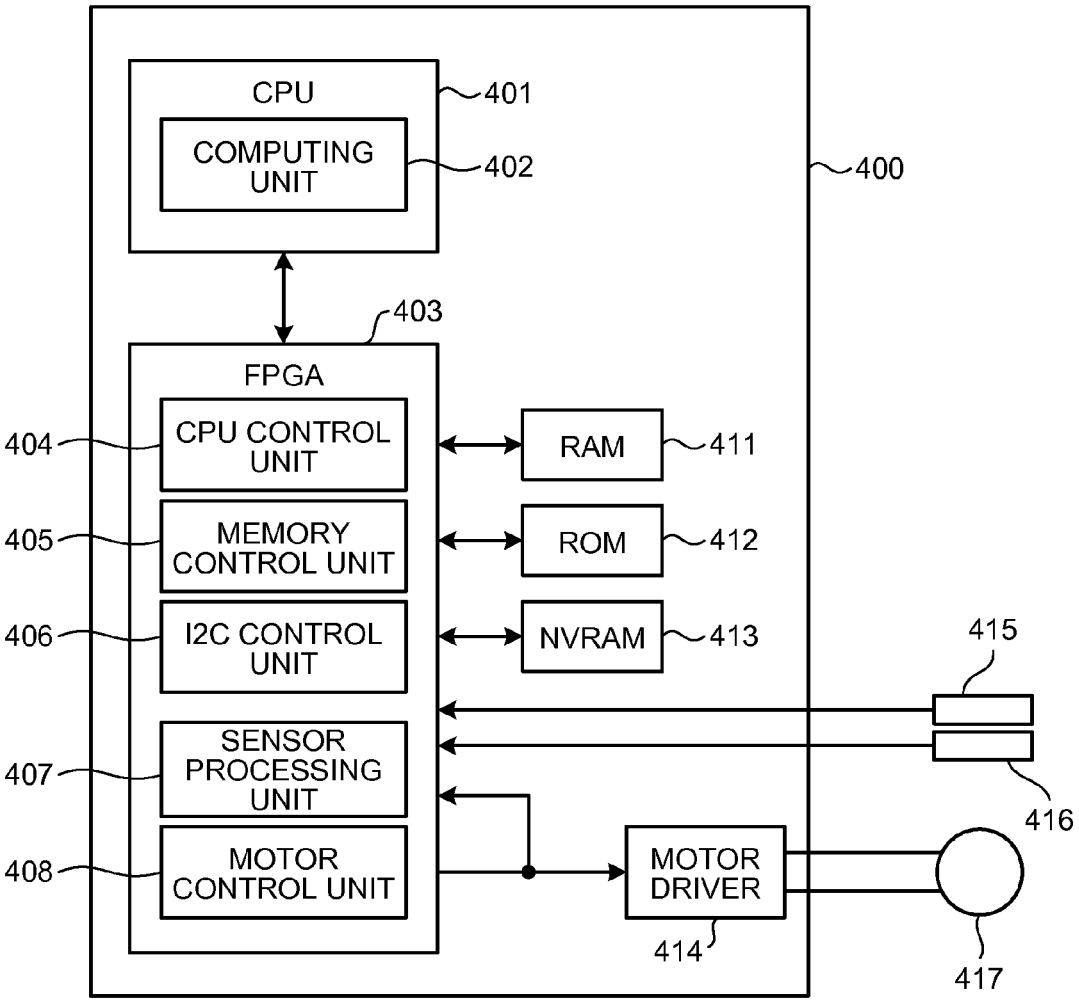
FIG. 4 is an explanatory block diagram for describing an overview of a control unit of the apparatus.

An overview of a control unit of the image forming apparatus is described below with reference to an explanatory block diagram illustrated in FIG. 4.

A control unit 400 includes a central processing unit (CPU) 401, a field programmable gate array (FPGA) 403, a random access memory (RAM) 411, a read only memory (ROM) 412, a nonvolatile random-access memory (NVRAM) 413, and motor driver 414.

A computing unit 402 of the CPU 401 carries out communications with units of the FPGA 403.

The FPGA 403 includes a CPU control unit 404 that carries out communications with the CPU 401, a memory control unit 405 for accessing memories such as the ROM 412 and the RAM 411, and an inter integrated circuit (I2C) control unit 406 that carries out communications with the NVRAM 413.

The FPGA 403 also includes a sensor processing unit 407 that processes sensor signals output from a temperature-and-humidity sensor 415 that detects an ambient temperature and an ambient humidity of the apparatus, encoder sensors 416, and the like. The sensor processing unit 407 is a component of a generating unit that generates a position signal and a velocity signal of the carriage 5 from output signals of the linear encoder 42.

The FPGA 403 also includes a motor control unit 408 that controls driving of motors 417, which include the main-scanning motor 8, of various units.

The encoder sensors 416 include the encoder sensor 41 of the linear encoder 42 described above that detects a position/velocity of the carriage 5 and an encoder sensor of a rotary encoder (not shown) that detects a rotation amount of the conveying roller 23 and the like.

The motors 417 include, in addition to the main-scanning motor 8 described above, a sub-scanning motor that drives the conveying roller 23 to rotate and a paper feed motor that drives the pair of conveying rollers 131 to rotate. A DC motor, a stepping motor, or the like can be used as the motor.

Operations of the main-scanning motor 8, which is one of the motors 417, are described below.

The CPU 401 provides an operation start command and, simultaneously therewith, specification of a velocity and a travel distance to the motor control unit 408.

Upon receiving the command and specification from the CPU 401, the motor control unit 408 creates a drive profile based on the velocity/travel-distance specifying information, and compares the drive profile against encoder information obtained from the encoder sensor 41, which is one of the encoder sensors 416, via the sensor processing unit 407. The motor control unit 408 calculates a PWM command value and outputs the PWM command value to the motor driver 414.

Upon completion of the predetermined operation, the motor control unit 408 transmits an end-of-operation notification to the CPU 401. The CPU 401 receives the end-of-operation command.

There may be employed a configuration, in which the drive profile is created by the CPU 401 rather than by the motor control unit 408, and the CPU 401 provides the command and specification to the motor control unit 408.

In short, in the embodiment, the CPU 401 and the motor control unit 408 make up a drive control unit that controls driving of the main-scanning motor 8, which is a driving source of the carriage 5, by pulse width modulation (PWM) control.

In the embodiment, the CPU 401 also performs processing of counting the number of printed sheets and counting the number of moves (the number of scanning motions) made by the carriage 5.

Note that a detecting unit, a calculating unit, a comparing unit, a stop-output command unit that outputs a command to stop driving of the carriage, and the like according to an embodiment of the invention are implemented by the control unit 400. A storing unit is implemented by the RAM 411, the NVRAM 413, a memory in the motor control unit 408, or the like.

Figure 5:
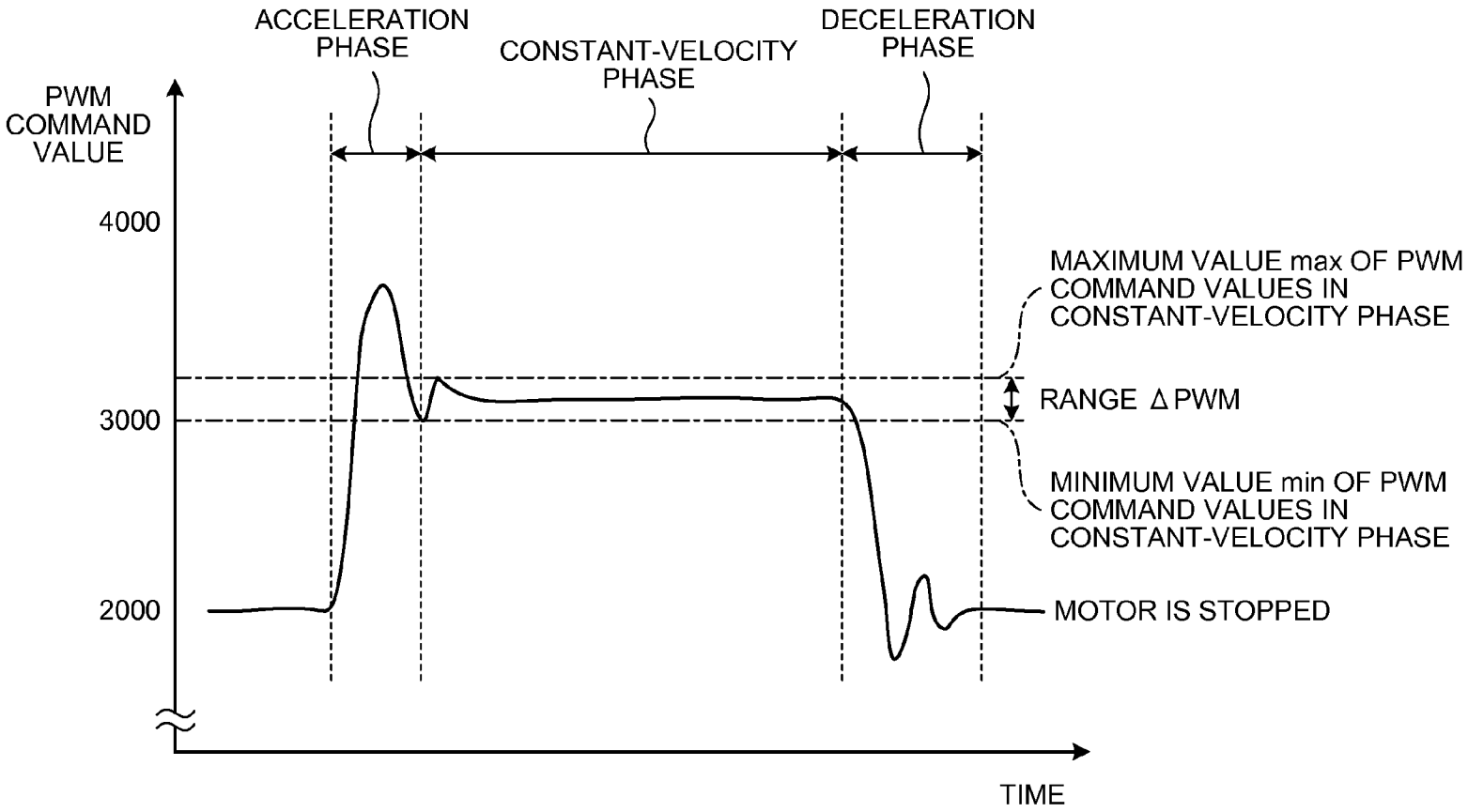
FIG. 5 is an explanatory diagram, for describing an example of carriage velocity control, describing how a PWM-duty-ratio command value for a carriage velocity changes during a single scanning motion (forward-moving operation) of a carriage.

An example of carriage velocity control is described below with reference to FIG. 5. FIG. 5 is an explanatory diagram describing how a PWM-duty-ratio command value for the carriage velocity changes during a single scanning motion (forward-moving operation) of the carriage.

In the embodiment, driving of the main-scanning motor 8 that moves the carriage 5 in a scanning manner is controlled by PWM control using a servo system having a proportional-integral (PI) control loop. This system controls the velocity of the carriage by causing a command value (hereinafter, "PWM command value"), on which the PWM duty ratio depends, to vary.

The PWM command value is assigned as illustrated in FIG. 6, for example.

An example of such motor velocity control performed by controlling the PWM duty ratio is described below.

A moving velocity or a motor rotation speed of a control target (in this example, the carriage) that is detected by a position/velocity detecting unit, such as the encoder, is subtracted from an externally-supplied command velocity, thereby calculating a velocity error (Ve) first.

A manipulated variable (in this example, the PWM duty ratio) is calculated using Equation (1) below. In Equation (1), Kp is a proportional control constant, and Ki is an integral control constant.

$$PWM=Kp\times Ve+Ki\times\int Ve\cdot dt \quad (1)$$

The velocity of the carriage 5 is controlled by changing the PWM command value to be fed to the motor driver 414 according to the calculated value.

Although PI control is performed in the embodiment, proportional-integral-derivative (PID) control may alternatively be performed.

Referring back to FIG. 5, the carriage velocity is controlled as follows. The carriage 5 is gradually accelerated in an acceleration phase subsequent to startup of the main-scanning motor 8 so that neither noise nor vibrations are created by an operation of moving the carriage.

When the carriage 5 reaches a predetermined target position, control enters a constant-velocity phase where constant-velocity control is performed. In a constant-velocity phase, the recording heads are driven to form an image.

After the image is formed, control enters a deceleration phase where the main-scanning motor 8 is immediately decelerated to a stop.

In this case, control in the constant-velocity phase and the deceleration phase is performed in a manner not to create noise or the like due to steep change in velocity; moreover, control in the constant-velocity phase is performed so as not to decrease recording accuracy.

Figure 7:
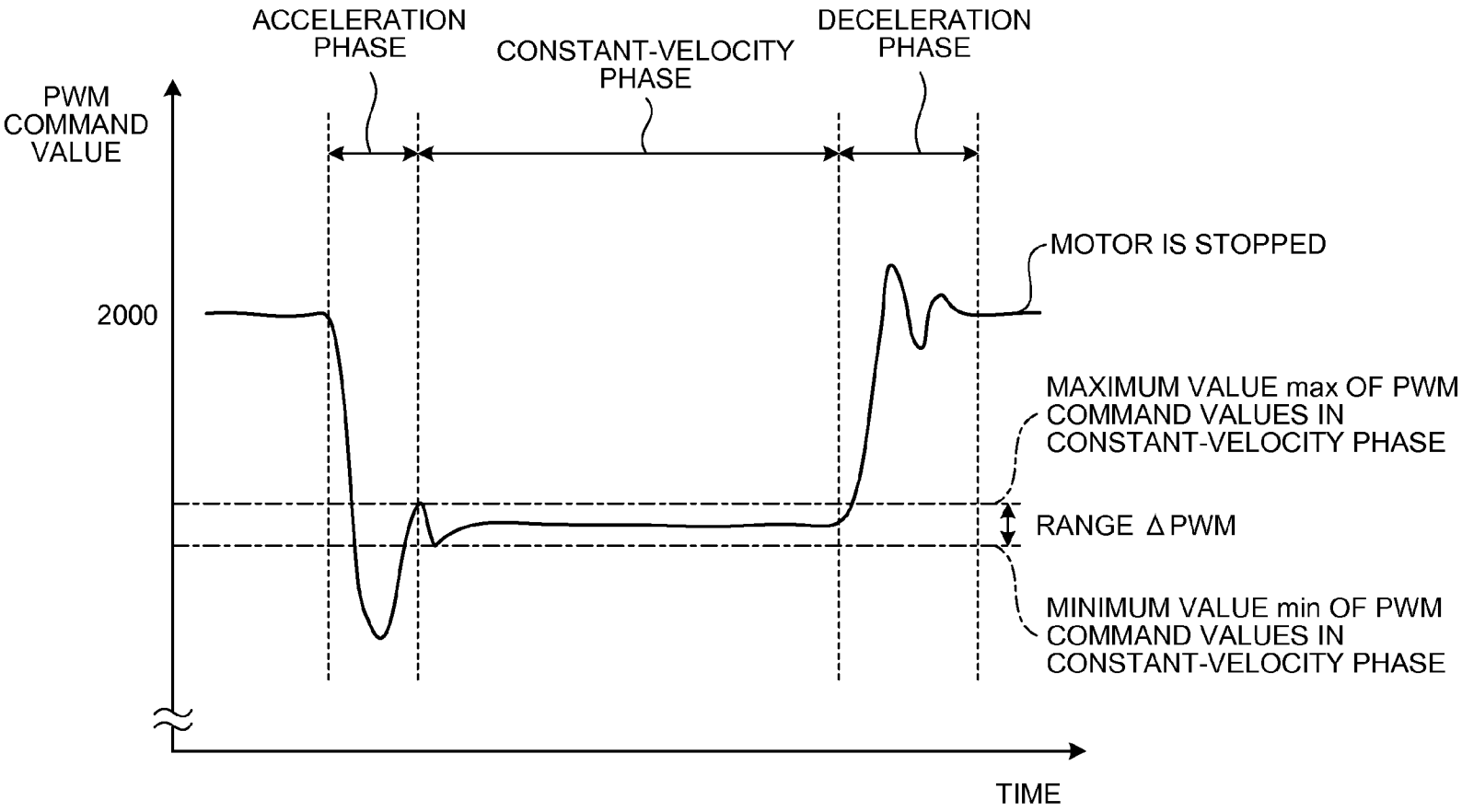
FIG. 7 is an explanatory diagram, for describing an example of the carriage velocity control, describing how the PWM-duty-ratio command value for the carriage velocity changes during a single scanning motion (backward-moving operation) of the carriage.

FIG. 7 illustrates an example of how the PWM-duty-ratio command value for the carriage velocity changes during a backward-moving operation of the carriage.

Figure 8:
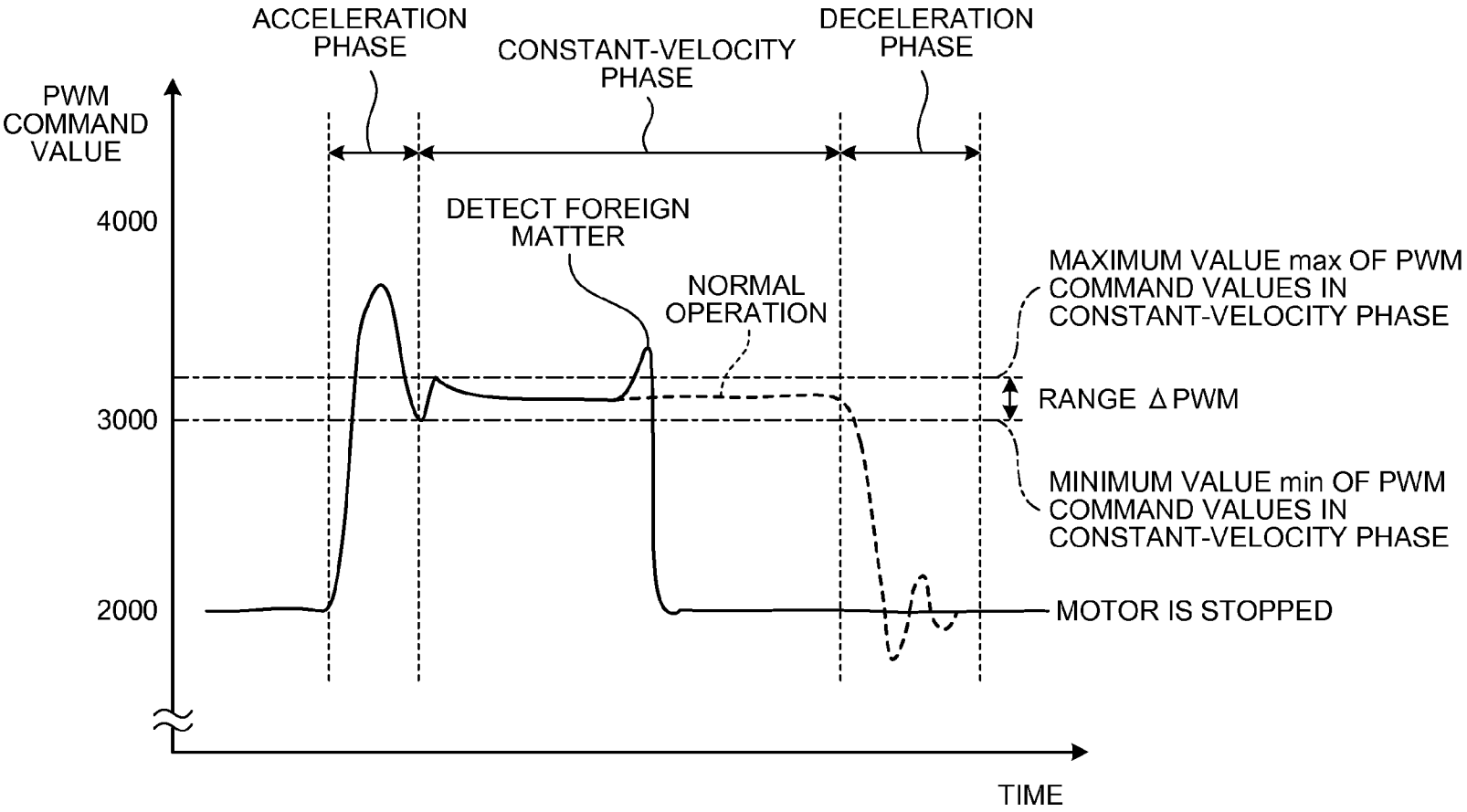
FIG. 8 is an explanatory diagram describing an example of how the PWM-duty-ratio command value for the carriage changes when the carriage that is moving contacts a foreign matter.

How the carriage operates when the carriage, while moving, contacts a foreign matter is described below with reference to FIG. 8. FIG. 8 is an explanatory diagram describing an example of how the PWM-duty-ratio command value for the carriage changes when the carriage that is moving contacts a foreign matter.

Referring to FIG. 8, in the constant-velocity control performed in the constant-velocity phase, a maximum value max (hereinafter, also referred to as "Max") and a minimum value min (hereinafter, also referred to as "Min") of PWM command values are stored, and a difference (which is referred to as "range" hereinafter) ΔPWM between the maximum value max and the minimum value min is calculated.

Foreign matter detection (detection as to whether or not the carriage has contacted a foreign matter) is made by comparing the calculated range ΔPWM against a pre-established threshold value.

More specifically, when the carriage 5 moving at a constant velocity contacts a foreign matter, a difference between the detected velocity (detected position), which is based on outputs of the encoder sensor 41, and a target velocity (target position) becomes wider. In such a case, the motor control unit 408 changes the PWM command value so as to increase the velocity of the main-scanning motor 8.

As the PWM command value changes, the range ΔPWM between the maximum value max and the minimum value min of the PWM command values becomes wider. When the range ΔPWM of the PWM command value exceeds the pre-established threshold value, the PWM command value for the main-scanning motor 8 is forcefully changed to a motor-stop command (in the example illustrated in FIG. 6, the PWM command value is changed to 2,000) to stop driving of the main-scanning motor 8, thereby stopping the carriage 5. That is, the motor control unit 408 (the stop-output command unit) outputs the command to stop driving of the carriage 5.

By establishing the threshold value for the range of the PWM command value as described above, contact between the carriage and a foreign matter can be detected and determined accurately and reliably.

More specifically, the PWM command value in the constant-velocity phase of the carriage is susceptible to an influence of a load and the like and can vary from time to time. By contrast, the range of the PWM command value remains unchanged even when the load varies; accordingly, the PWM command value varies in such a manner that the PWM command value is counterbalanced.

For instance, even when the velocity to be achieved remains the same, the heavier the load, the higher the PWM command value; the lighter the load, the lower the PWM command value. In contrast, the range of the PWM command value varies little.

Accordingly, by establishing the threshold value for the range of the PWM command value, it becomes possible to perform foreign matter detection using the single, same threshold value even when the load varies.

Meanwhile, the velocity in the constant-velocity phase can also vary depending on a print mode (a mode that places a higher priority to speed than image quality or a mode that places a higher priority to image quality than speed) and/or an operation, such as paper loading.

Even in such a case, by establishing the threshold value for the range of the PWM command value, it becomes possible to perform foreign matter detection using the single, same threshold value.

Furthermore, it becomes possible to adapt even to variation in the PWM command value resulting from a change in the ambient environment.

Main-scanning motor control according to a first implementation example of the embodiment is described below with reference to a flow diagram illustrated in FIG. 9.

The motor control unit 408 performs an acceleration and deceleration process first (S101).

Next, whether or not the currently-performed operation is an initial operation (an operation that moves the carriage for the first time) is determined (S102).

If the currently-performed operation is the initial operation, control enters a first constant-velocity phase process (S103). Examples of the initial operation include an operation performed at power-on and an operation performed when exiting an energy saving mode (which is a mode where power supply to at least a portion of the apparatus is shut off).

If the first constant-velocity phase process is completed without detecting a foreign matter, control enters the deceleration phase process (S105), and the procedure for the main-scanning motor control ends.

On the other hand, if the first constant-velocity phase process is not completed without detecting a foreign matter, the procedure for the motor control ends, and the carriage 5 is stopped.

If the currently-performed operation is determined as not being the initial operation in S102 or, put another way, an operation performed for the second or later time, control enters a second constant-velocity phase process (S104).

If the second constant-velocity phase process is completed without detecting a foreign matter, control enters the deceleration phase process (S105), and the procedure for the main-scanning motor control ends.

If the second constant-velocity phase process is not completed without detecting a foreign matter, the procedure for the motor control ends, and the carriage 5 is stopped.

In this example, foreign matter detection is performed in the constant-velocity phase; however, a phase for foreign matter detection is not limited to the constant-velocity phase. Foreign matter detection may be performed in any phase in the printing area within the constant-velocity phase.

Figure 9:
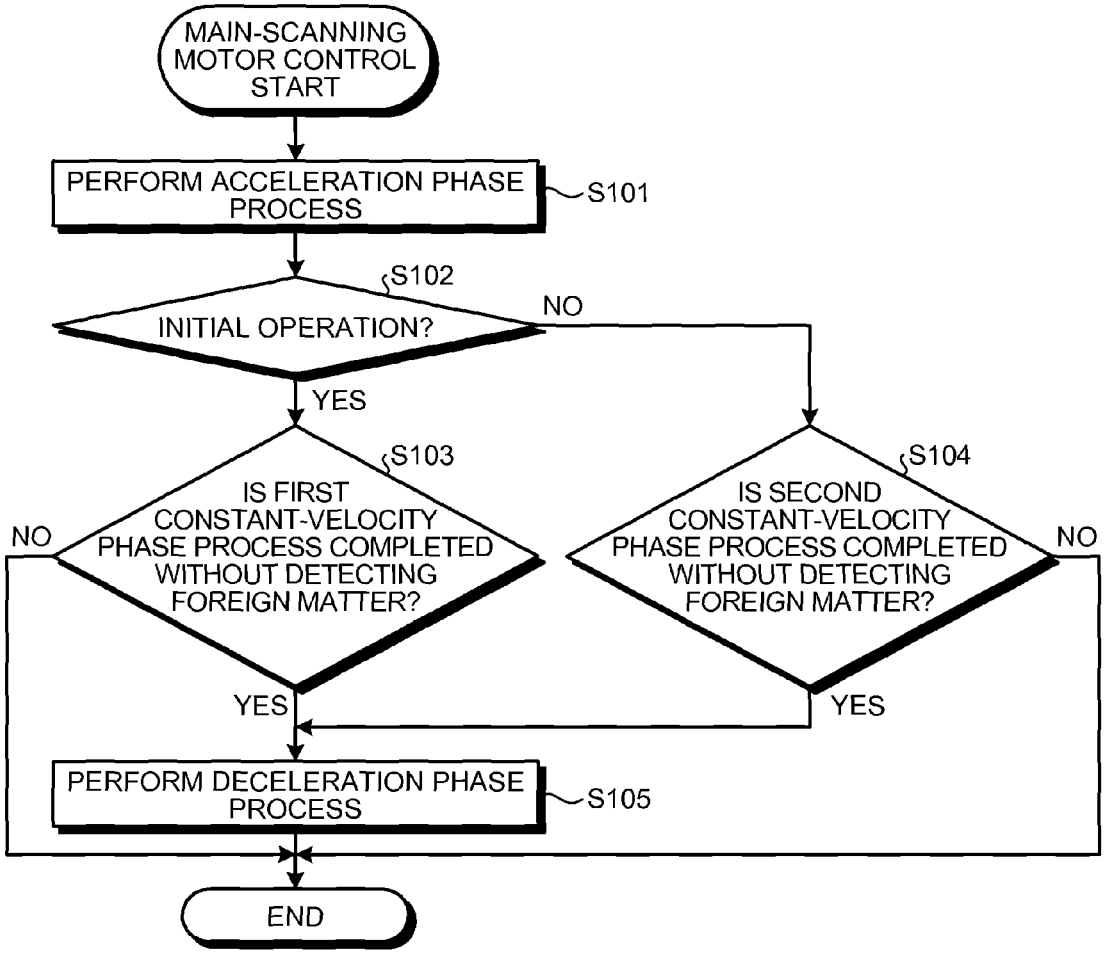
FIG. 9 is a flow diagram for describing main-scanning motor control according to a first implementation example of the embodiment.
Figure 10:
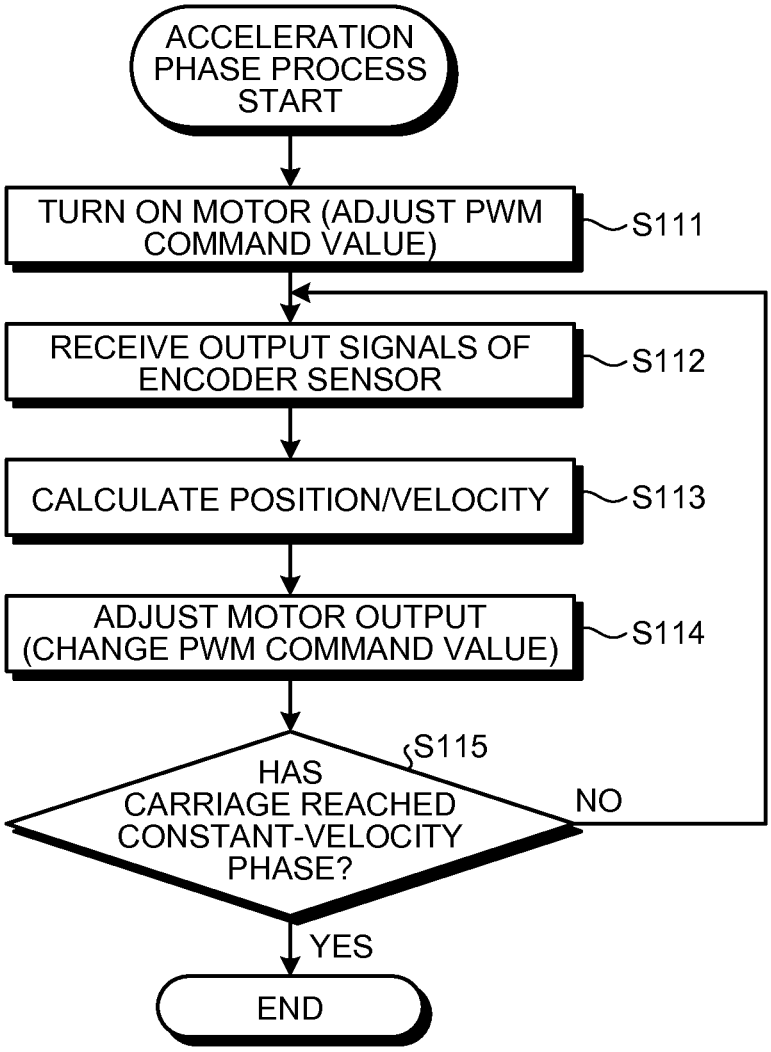
FIG. 10 is a flow diagram illustrating an example of an acceleration phase process illustrated in FIG. 9.

The acceleration phase process illustrated in FIG. 9 is described below with reference to FIG. 10.

First, the main-scanning motor 8 is started up (turned on) by adjusting a PWM command value (S111), causing the carriage 5 to start moving.

The motor control unit 408 receives signals that are output from the encoder sensor 41 of the linear encoder 42 as the carriage 5 moves (S112), and calculates a position/velocity of the carriage 5 from the received signals (S113).

Subsequently, the motor control unit 408 determines a PWM command value based on the position/velocity calculation result, and adjusts a PWM duty ratio (i.e., adjusts motor output) (S114).

The procedure (control) from S112 to 5115 is repeated while accelerating the main-scanning motor 8 until the carriage 5 reaches the constant-velocity phase. When the carriage 5 reaches the constant-velocity phase, the acceleration phase process ends.

Figure 11:
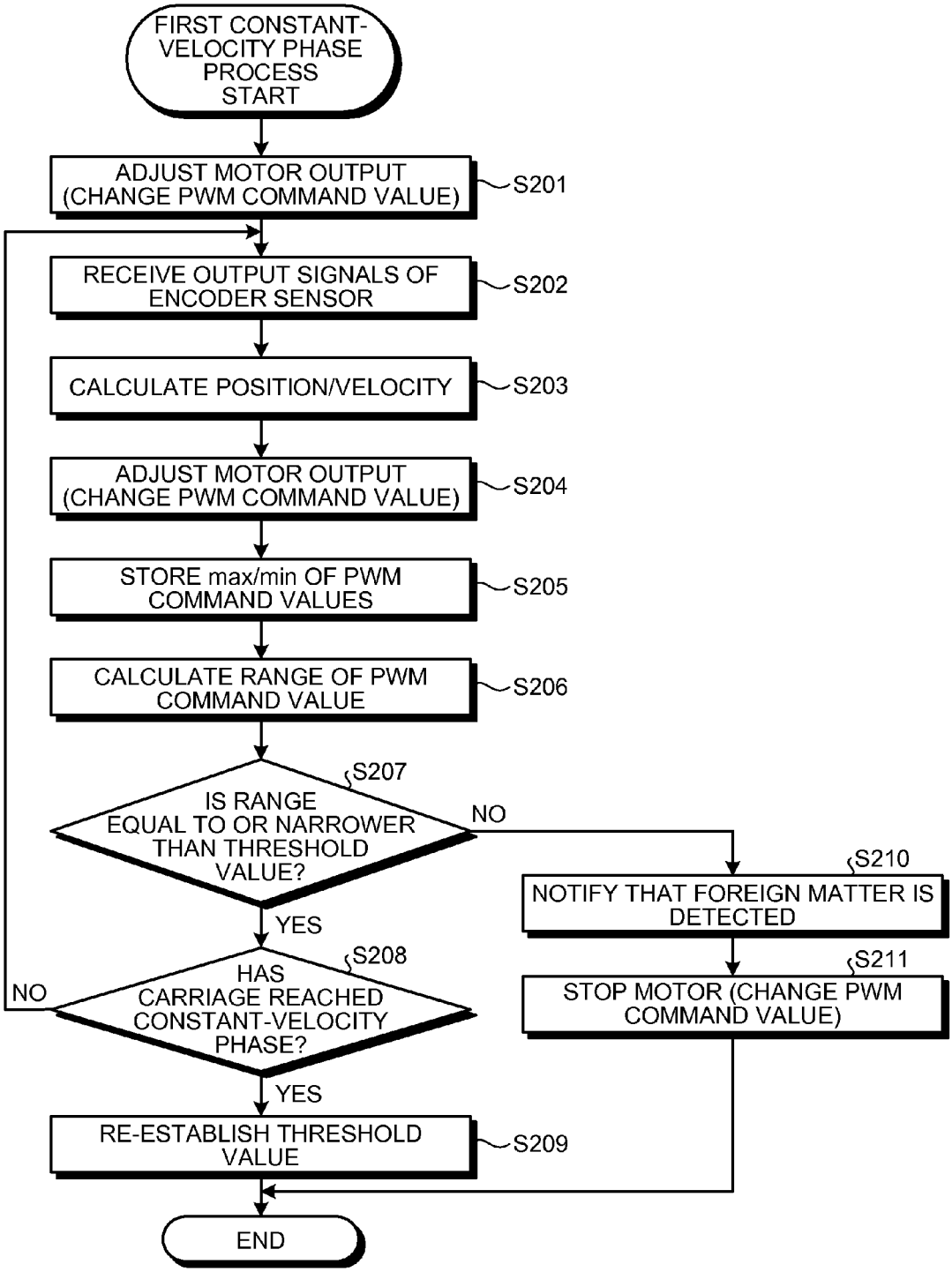
FIG. 11 is a flow diagram illustrating an example of a first constant-velocity phase process illustrated in FIG. 9.

The first constant-velocity phase process illustrated in FIG. 9 is described below with reference to the flow diagram illustrated in FIG. 11.

In the first constant-velocity phase process, simultaneously with the constant-velocity control for the main-scanning motor 8, establishing a threshold value for use in detection of paper floating and detection of a foreign matter (which is collectively referred to as "foreign matter detection") and foreign matter detection are also performed.

The motor control unit 408 adjusts a motor output by changing a PWM command value, first (S201). The motor control unit 408 receives output signals of the encoder sensor 41 (S202), and calculates a position/velocity from the received signals (S203).

The motor control unit 408 determines a PWM command value based on the position/velocity calculation result, and adjusts a PWM duty ratio (S204).

If, after the adjustment, the PWM command value is the maximum value max or the minimum value min in the constant-velocity phase, the motor control unit 408 stores the value in a memory (storing unit) (S205). The memory can be the RAM 411, a RAM provided in the motor control unit 408 for the single purpose of controlling the motor, or the like.

The motor control unit 408 calculates the range ΔPWM of the PWM command value from the stored maximum value max and the minimum value min of the PWM command values (S206).

Thereafter, the motor control unit 408 determines whether or not the range ΔPWM of the PWM command value is equal to or narrower than the threshold value (S207).

As described above, in a case of the initial operation after power-on or when exiting the energy saving mode, a default threshold value is used. For instance, the default threshold value may be established in advance by loading the default threshold value having been stored in the ROM 412 onto the RAM 411.

If the range ΔPWM of the PWM command value is equal to or narrower than the threshold value, the motor control unit 408 determines whether or not the carriage 5 has reached the deceleration phase (S208). The procedure from S202 to S207 is repeated until the carriage 5 reaches the deceleration phase.

The motor control unit 408 calculates and establishes a threshold value for foreign matter detection by multiplying the range ΔPWM of the PWM command value obtained from the stored maximum value max and the minimum value min of the PWM command values by a predetermined coefficient. The calculated and established threshold value is stored in the memory (storing unit) (S209). The procedure described above is performed to re-establish the threshold value. Thereafter, the first constant-velocity phase process ends.

On the other hand, if the range ΔPWM of the PWM command value is wider than the threshold value, the motor control unit 408 sends a notification that a foreign matter is detected to the CPU 201 by interruption (S209). The motor control unit 408 forcefully changes the PWM command value for the main-scanning motor 8 to a motor-stop command (in the example described above, the PWM command value is changed to 2,000) to stop the main-scanning motor 8 (S211). Thereafter, the first constant-velocity phase process ends.

By performing foreign matter detection by comparing the range of the PWM command value against the threshold value in this manner, it becomes possible to make accurate and reliable detection and determination of contact between the carriage and a foreign matter.

Described below is an example, in which a threshold value (hereinafter, "previous threshold value") of an immediately preceding operation (operation performed with power-on) is stored in a memory, and the stored threshold value is used in place of the default threshold value.

In this case, determination for foreign matter detection is made using the previous threshold value in the initial operation after power-on or when exiting the energy saving mode. For example, the previous threshold value may be established in advance by loading the previous threshold value having been stored in the NVRAM 413 onto the RAM 411 at power-on.

As described above, if the range of the PWM command value is equal to or narrower than the threshold value, a threshold value for foreign matter detection is calculated and established by multiplying the range of the PWM command value by the predetermined coefficient. The calculated and established threshold value is stored in the memory (storing unit).

If the range of the PWM command value is wider than the threshold value, a notification that a foreign matter is detected is sent to the CPU 201. A process of forcefully changing the PWM command value for the main-scanning motor 8 to a motor-stop command to thereby stop the main-scanning motor 8 is performed.

The reason why the threshold value is calculated and established each time in the first constant-velocity phase process is described below.

That is, the default threshold value to be set at power-on is established based on the range of the PWM command value, for which a certain margin is allowed so as not to cause false detection. Furthermore, the default threshold value is established with consideration given to variation in the PWM command value resulting from contamination of the encoder sheet.

Nevertheless, as the encoder sheet 40 is contaminated over time by mist or paper dust sticking, variation in the PWM command value in the constant-velocity phase becomes wider, and the range of the PWM command value increases.

In light of this circumstance, a threshold value suitable for variation in the PWM command value, which varies from apparatus to apparatus, can be established by re-establishing the threshold value in the initial operation. As a result, foreign matter detection can be performed immediately and reliably without false detection.

Even when the threshold value used in the previous operation performed with power-on is stored in the memory, the threshold value is desirably re-established in the initial operation after power-on or when exiting the energy saving mode. By re-establishing the threshold value, it becomes possible to adapt even to a change in variation of the PWM command value resulting from contamination, which accumulates over time, of the encoder sheet.

The carriage velocity for re-establishment of the threshold value is described below.

In the constant-velocity phase, the higher the velocity of the carriage, the wider the variation of the PWM command values; the lower the velocity, the narrower the variation of the PWM command values.

To take this into consideration, the carriage is desirably moved in a scanning manner at a maximum velocity, which depends on the apparatus, when re-establishing the threshold value. When the threshold value is re-established with this velocity, control can be performed without false detection at every possible carriage velocity.

As described above, in the embodiment, the re-establishment of the threshold value is performed when the operation of moving the carriage is performed for the first time after power-on or for the first time after exiting the energy saving mode, but not limited thereto.

For instance, there may be employed a configuration, in which the CPU 401 outputs a count of the number of printed sheets, and the re-establishment of the threshold value is performed when the count (of the number) of the printed sheets reaches a predetermined value.

There may be employed a configuration, in which the CPU 401 outputs a count of the number of moves (scanning motions) made by the carriage 5, and the re-establishment of the threshold value is performed when the count of the scanning motions reaches a predetermined value.

There may be employed a configuration, in which the motor control unit 408 receives information output from the temperature-and-humidity sensor 415 from the sensor processing unit 407, and performs the re-establishment of the threshold value when at least any one of an amount of change in temperature and an amount of change in humidity exceeds a predetermined value.

These conditions for re-establishment of the threshold value may be combined.

Each of the conditions (including the combinations) for re-establishment of the threshold value can be implemented by modifying the procedure in S102 described above with reference to FIG. 9 to a corresponding re-establishment condition.

Figure 12:
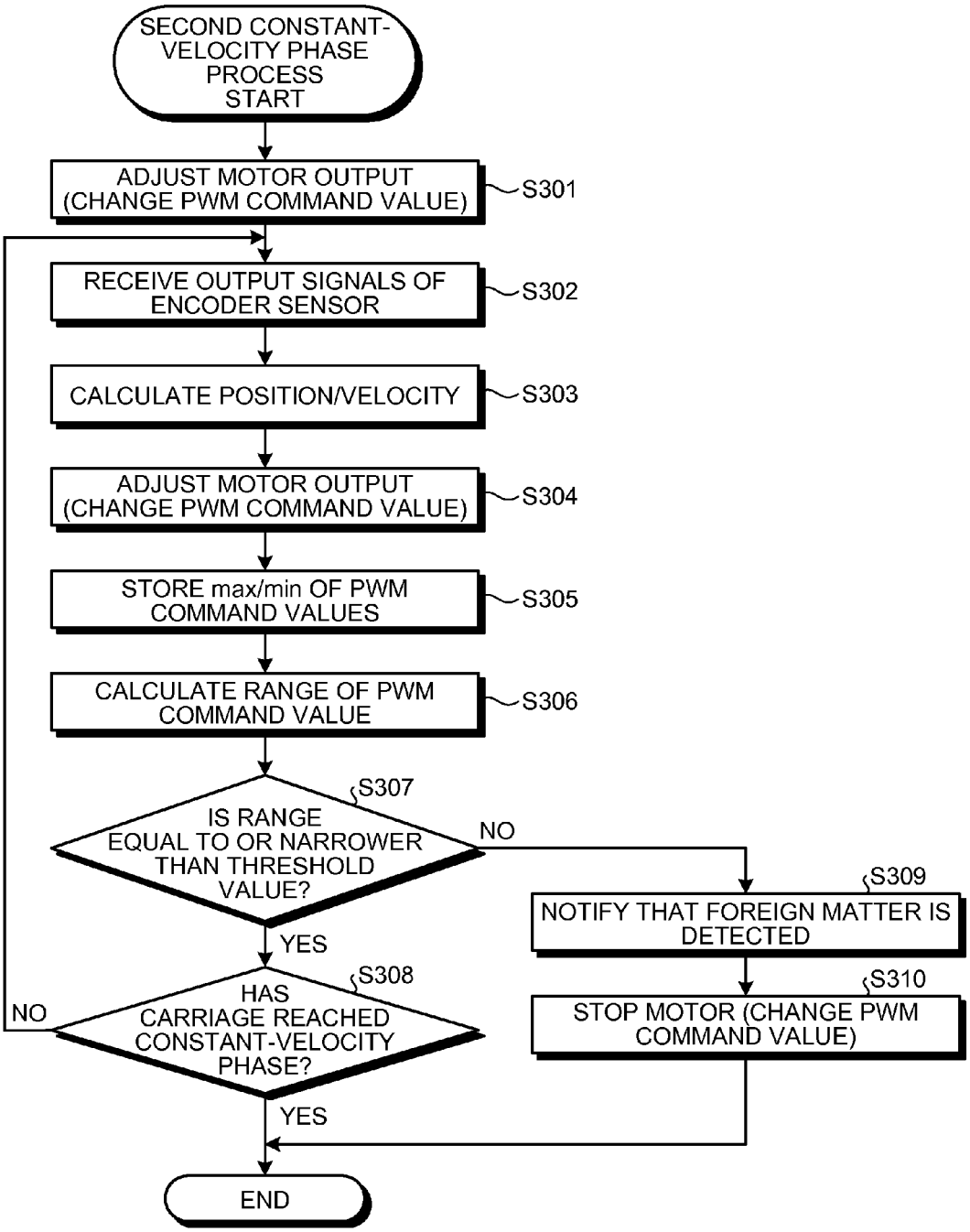
FIG. 12 is a flow diagram illustrating an example of a second constant-velocity phase process illustrated in FIG. 9.

The second constant-velocity phase process illustrated in FIG. 9 is described below with reference to the flow diagram illustrated in FIG. 12.

In the second constant-velocity phase process, simultaneously with the constant-velocity control for the main-scanning motor 5, establishing a threshold value for use in detection of paper floating or a foreign matter (foreign matter detection) and foreign matter detection are also performed.

The motor control unit 301 adjusts a motor output by changing the PWM command value, first (S301). The motor control unit 408 receives output signals of the encoder sensor 41 (S302), and calculates a position/velocity from the received signals (S303).

The motor control unit 408 determines a PWM command value based on the position/velocity calculation result, and adjusts a PWM duty ratio (S304).

If, after the adjustment, the PWM command value is the maximum value max or the minimum value min in the constant-velocity phase, the motor control unit 408 stores the value by overwriting the previous value stored in the memory (storing unit) with the value (S305).

The motor control unit 408 calculates the range ΔPWM of the PWM command value from the stored maximum value max and the minimum value min of the PWM command values (S306).

Thereafter, the motor control unit 408 determines whether or not the range ΔPWM of the PWM command value is equal to or narrower than the threshold value (S307).

If the range ΔPWM of the PWM command value is equal to or narrower than the threshold value, the motor control unit 408 determines whether or not the carriage 5 has reached the deceleration phase (S308). The procedure from S302 to S307 is repeated until the carriage 5 reaches the deceleration phase.

After the carriage 5 reaches the deceleration phase, the second constant-velocity phase process ends.

On the other hand, if the range ΔPWM of the PWM command value is wider than the threshold value, the motor control unit 408 sends a notification that a foreign matter is detected to the CPU 201 by interruption (S309). The motor control unit 408 forcefully changes the PWM command value for the main-scanning motor 8 to a motor-stop command (in the example described above, the PWM command value is changed to 2,000) to stop the main-scanning motor 8 (S310). Thereafter, the second constant-velocity phase process ends.

By performing foreign matter detection by comparing the range of the PWM command value against the threshold value in this manner, it becomes possible to make accurate and reliable detection and determination of contact between the carriage and a foreign matter.

Figure 13:
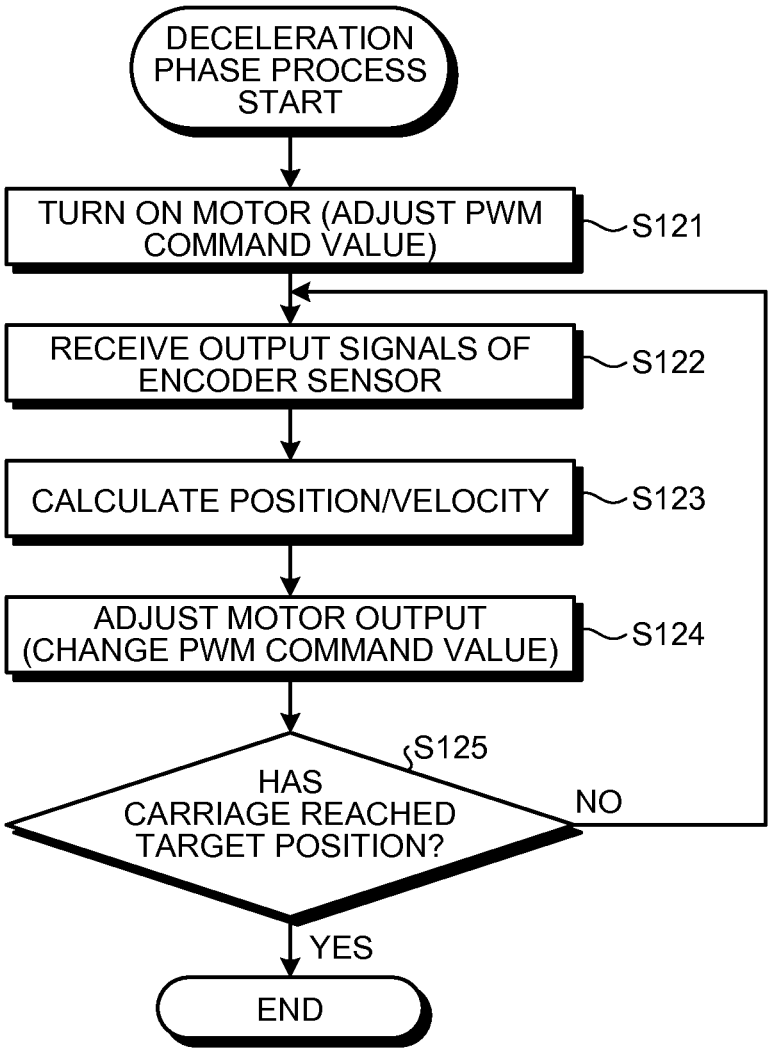
FIG. 13 is a flow diagram illustrating an example of a deceleration phase process illustrated in FIG. 9.

The deceleration phase process illustrated in FIG. 9 is described below with reference to the flow diagram illustrated in FIG. 13.

Motor output is adjusted by changing the PWM command value, first (S121). The motor control unit 408 receives signals that are output from the encoder sensor 41 of the linear encoder 42 as the carriage 5 moves (S122), and calculates a position/velocity of the carriage 5 from the received signals (S123).

Subsequently, the motor control unit 408 determines a PWM command value based on the position/velocity calculation result, and adjusts a PWM duty ratio (i.e., adjusts the motor output) (S124).

The procedure (control) from S122 to S125 is repeated, while decelerating the main-scanning motor 8, until the carriage 5 reaches a target position. When the carriage 5 reaches the target position, the deceleration phase process ends.

Figure 14:
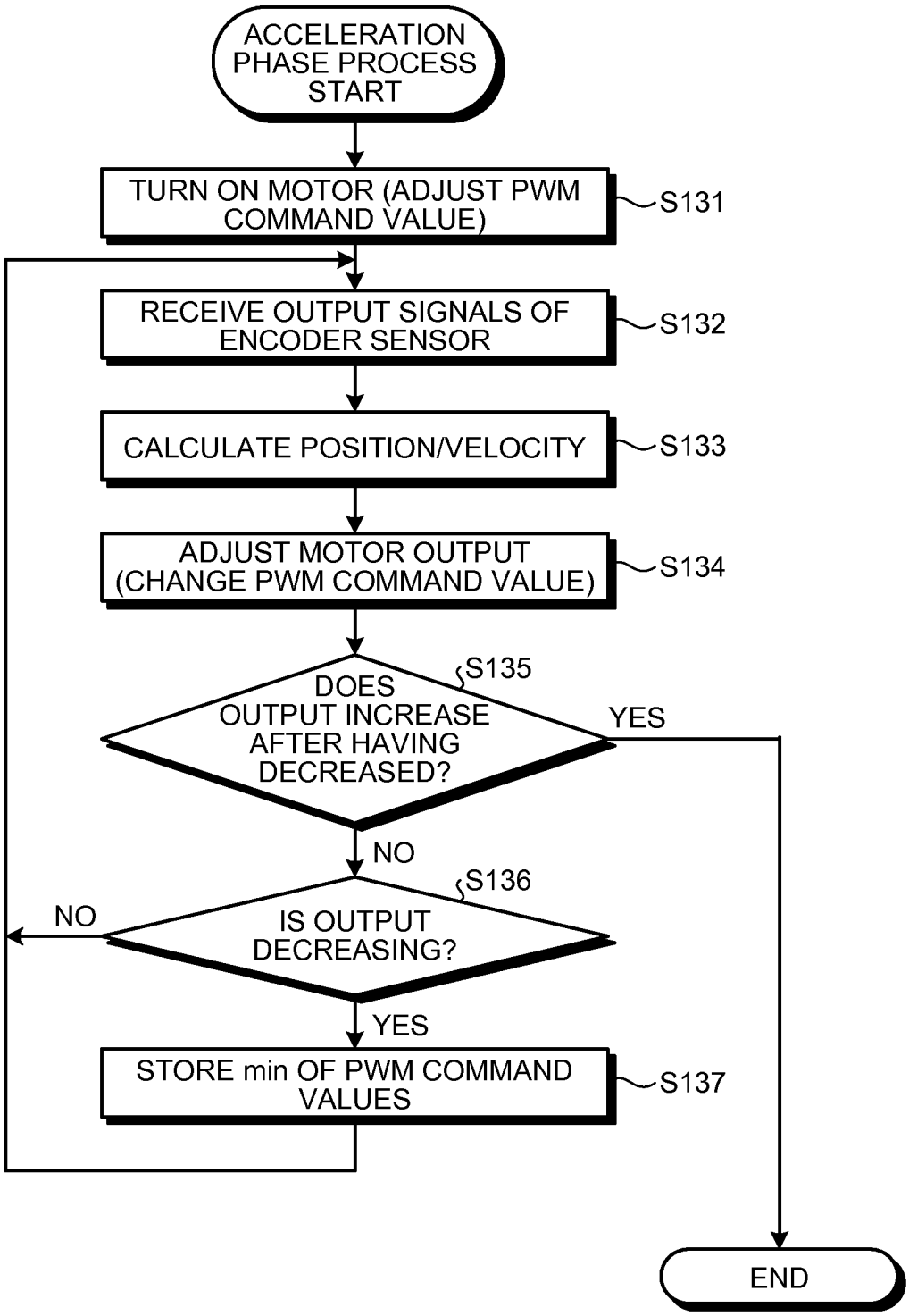
FIG. 14 is a flow diagram for describing an acceleration phase process illustrated in FIG. 9 according to a second implementation example of the embodiment.

A second implementation example of the embodiment is described below with reference to FIG. 14. FIG. 14 is a flow diagram for describing an acceleration phase process illustrated in FIG. 9 according to the second implementation example.

In the first implementation example, switching from the acceleration phase to the constant-velocity phase is performed according to the predetermined position/velocity, period of time, or the like. By contrast, in the second implementation example, switching from the acceleration phase to the constant-velocity phase is performed according to a change in output.

It becomes possible to maintain a minimum value of the PWM command values after an output peak that appears in the acceleration phase by storing the minimum value in a manner to overwrite the existing minimum value min of the PWM command values over a period when an output value is decreasing. As in the case of the first implementation example, the stored minimum value min of the PWM command values is continuingly used in the constant-velocity phase process.

When an increase in the output is detected after the output has decreased, it is assumed that the carriage has reached the constant-velocity phase, and the acceleration phase process ends.

More specifically, with reference to FIG. 14, the main-scanning motor 8 is started up (turned on) by adjusting the PWM command value (S131), causing the carriage 5 to start moving.

The motor control unit 408 receives signals that are output from the encoder sensor 41 of the linear encoder 42 as the carriage 5 moves (S132), and calculates a position/velocity of the carriage 5 from the received signals (S133).

Subsequently, the motor control unit 408 determines a PWM command value based on the position/velocity calculation result, and adjusts a PWM duty ratio (i.e., adjusts the motor output) (S134).

If, after the adjustment, the PWM command value is a minimum value in the output-decreasing period in the acceleration phase, the motor control unit 408 stores and retains the minimum value as the minimum value Min of the PWM command values in the memory (storing unit) in a manner to overwrite the existing minimum value Min (S135 and S136).

The procedure (control) from S132 to S136 is repeated, while accelerating the main-scanning motor 8, until the output increases after having decreased. When the output increases (S137), the acceleration phase process ends.

Figure 15:
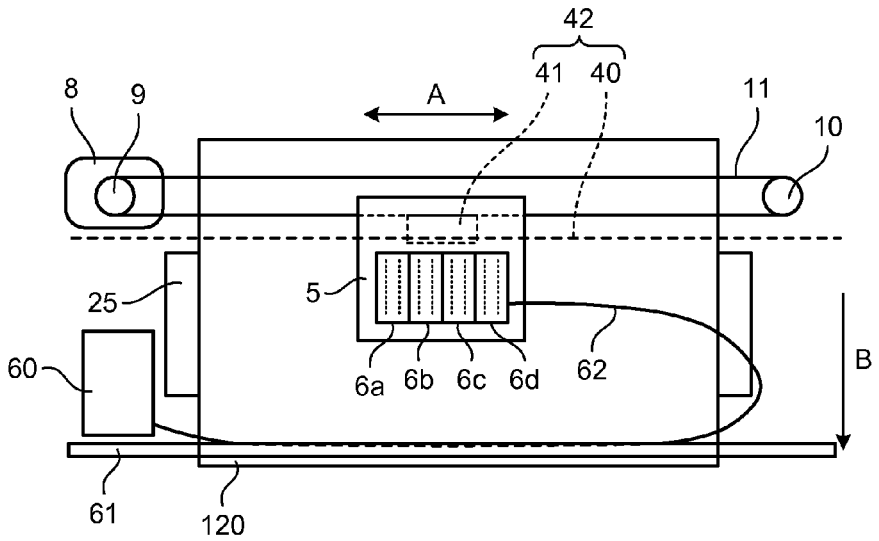
FIG. 15 is an explanatory plan view, for describing a third implementation example of the embodiment, of relevant portions of an image forming unit.

A third implementation example of the embodiment is described below. First, mechanical elements of the third implementation example are described below with reference to FIG. 15, which is a plan view of relevant portions.

In the third implementation example, mounted on the carriage 5 are the plurality of (in this example, four) recording heads 6*a* to 6*d* (referred to as "the recording heads 6" when no distinction is necessary) that are arranged in a line in the main-scanning direction. Each of the recording heads 6 includes the liquid ejection head and the head tank for supplying liquid to the head formed integrally in one piece.

The recording head 6*a* ejects black (K) droplets; the recording head 6*b* ejects cyan (C) droplets; the recording head 6*c* ejects magenta (M) droplets; the recording head 6*d* ejects yellow (Y) droplets, for example.

Ink of the respective colors is supplied to the head tanks of the recording heads 6 via a supply tube 62 from the ink cartridges 60, which are the main tanks replaceably attached to the apparatus body 101. The supply tube 62 is held by a tube guide 61 only at a portion where the supply tube 62 contacts the tube guide 61.

The third implementation example is similar to the image forming apparatus described above except for the configuration described above.

Figure 16:
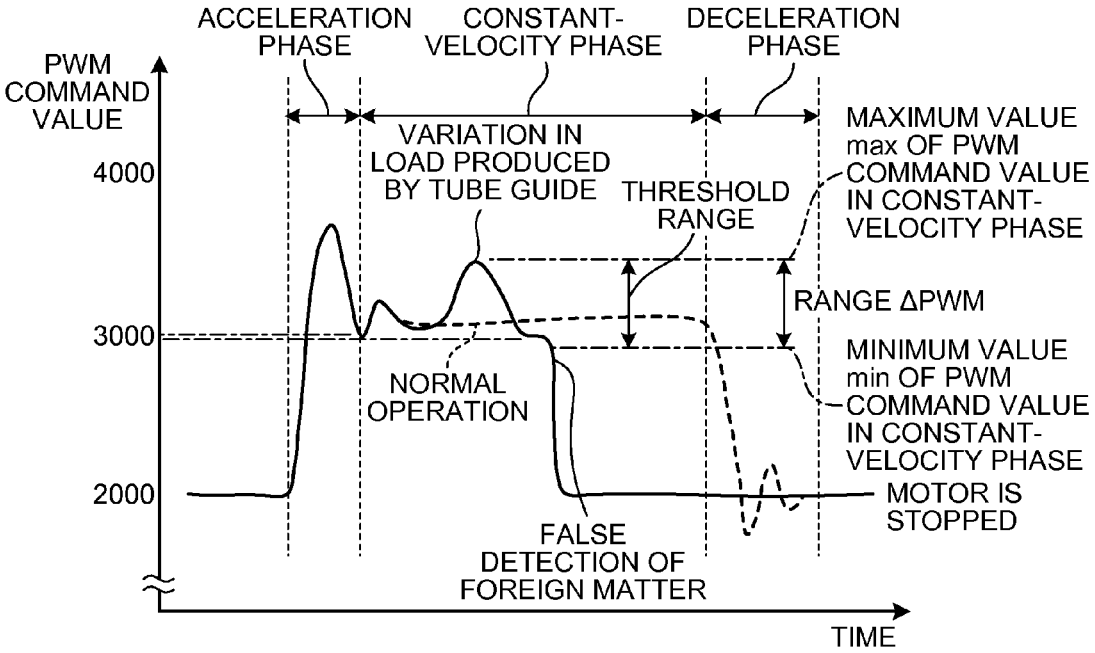
FIG. 16 is an explanatory diagram for describing how the PWM-duty-ratio command value for the carriage changes when false detection of a foreign matter occurs at or near a minimum value of a range of variation of the PWM command value in a situation where the range in the constant-velocity phase is large.

False detection of a foreign matter resulting from variation in load produced by the tube guide (or, more specifically, bending of the supply tube) is described below with reference to FIG. 16. FIG. 16 is an explanatory diagram describing how the PWM-duty-ratio command value for the carriage changes when false detection of a foreign matter occurs at or near the minimum value of a range of variation of the PWM command value in a situation where the range in the constant-velocity phase is large.

As described above, the PWM command value changes as illustrated in FIG. 8 when the carriage in the constant-velocity phase contacts a foreign matter. However, a cause that can widen the range of the PWM command value is not limited to a foreign matter.

For example, when the supply tube 62 connected to the recording heads 6 on the carriage 5 is bent, a reaction force of the bending can effect the carriage 5 and yield variation in load.

In this case, deviation from the preset threshold value, which has been determined in advance on an assumption that the minimum value will not vary greatly, of the range of the PWM command value unintentionally occurs, and the PWM command value for the main-scanning motor 8 is forcefully changed to a motor-stop command (the PWM command value: 2,000). Consequently, the main-scanning motor 8 is undesirably stopped. False detection of a foreign matter occurs in this way.

More specifically, as illustrated in FIG. 16, the PWM command value in the constant-velocity phase increases due to a load applied from the tube guide 61 and the supply tube 162 (note that FIG. 16 includes only a note about a load applied from the tube guide 61).

Thereafter, the PWM command value decreases to approximately a value of normal operation. However, when the load is lightened, the minimum value of the PWM value drops. As a result, the value of the range ΔPWM, which is calculated from the maximum value max and the minimum value min, undesirably exceeds the threshold value, by which the carriage 5 is unintentionally stopped.

Figure 17:
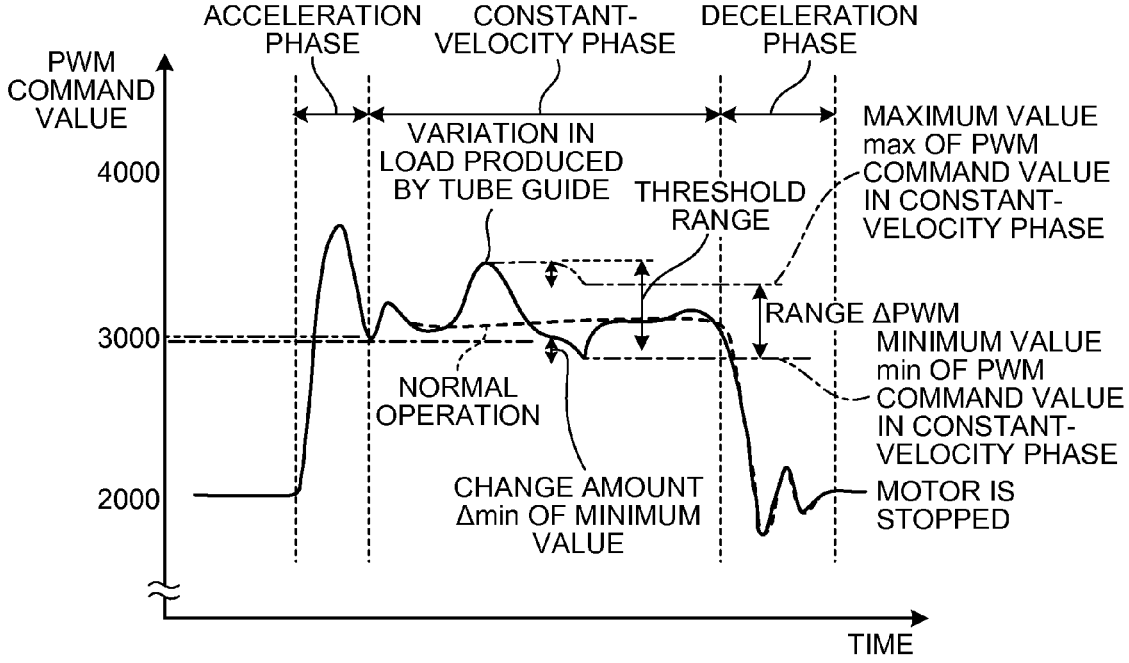
FIG. 17 is an explanatory diagram for describing how the PWM-duty-ratio command value for the carriage changes according to the third implementation example that prevents false detection of a foreign matter that can occur at or near a minimum value of the range of the PWM command value when the range is large.

Against the backdrop, the third implementation example is configured so as to, even when the range of the PWM command value is large as described above, prevent false detection of a foreign matter that would otherwise occur at or near the minimum value of the range. How the PWM-duty-ratio command value for the carriage changes according to the third implementation example is described below with reference to FIG. 17.

In the third implementation example, when the minimum value min changes, an amount of change of the minimum value (hereinafter, "the change amount Δmin") is subtracted from the maximum value max. This is to prevent the range ΔPWM of the PWM command value from undesirably deviating from the threshold range in a case where the minimum value min changes due to a cause other than a foreign matter.

This scheme causes a detection range (the range ΔPWM), which is the difference between the maximum value max and the minimum value min of the PWM command value, not to change with the change in the minimum value min. Accordingly, the range ΔPWM will not deviate from the threshold range, and therefore the carriage 5 is prevented from being stopped due to a change in the minimum value min.

More specifically, the range ΔPWM of the PWM command value is calculated by performing the following subtraction: ΔPWM=(maximum value max)−(minimum value min). When the minimum value min changes by the change amount Δmin, the maximum value max of the PWM command value is overwritten with a value obtained by subtracting the change amount Δmin from the maximum value max.

Accordingly, the range ΔPWM of the PWM command value remains the same as that before the minimum value min changes.

More specifically, when the stored minimum value of the PWM command value is to be changed, the difference (the change amount Δmin) in the minimum value of the PWM command value between pre-change and post-change minimum values is subtracted from the stored maximum value of the PWM command value, and the maximum value of the PWM command value is overwritten with the result of the subtraction.

This scheme allows, in a situation where the range of the PWM command value is large, preventing false detection of a foreign matter that would otherwise occur at or near the minimum value of the range.

Furthermore, this scheme can prevent false detection without changing the threshold range and therefore is free from detection delay that can occur when a scheme of preventing false detection by increasing the threshold value is employed. Accordingly, damage to the heads, the carriage, and the like can be minimized.

Figure 18:
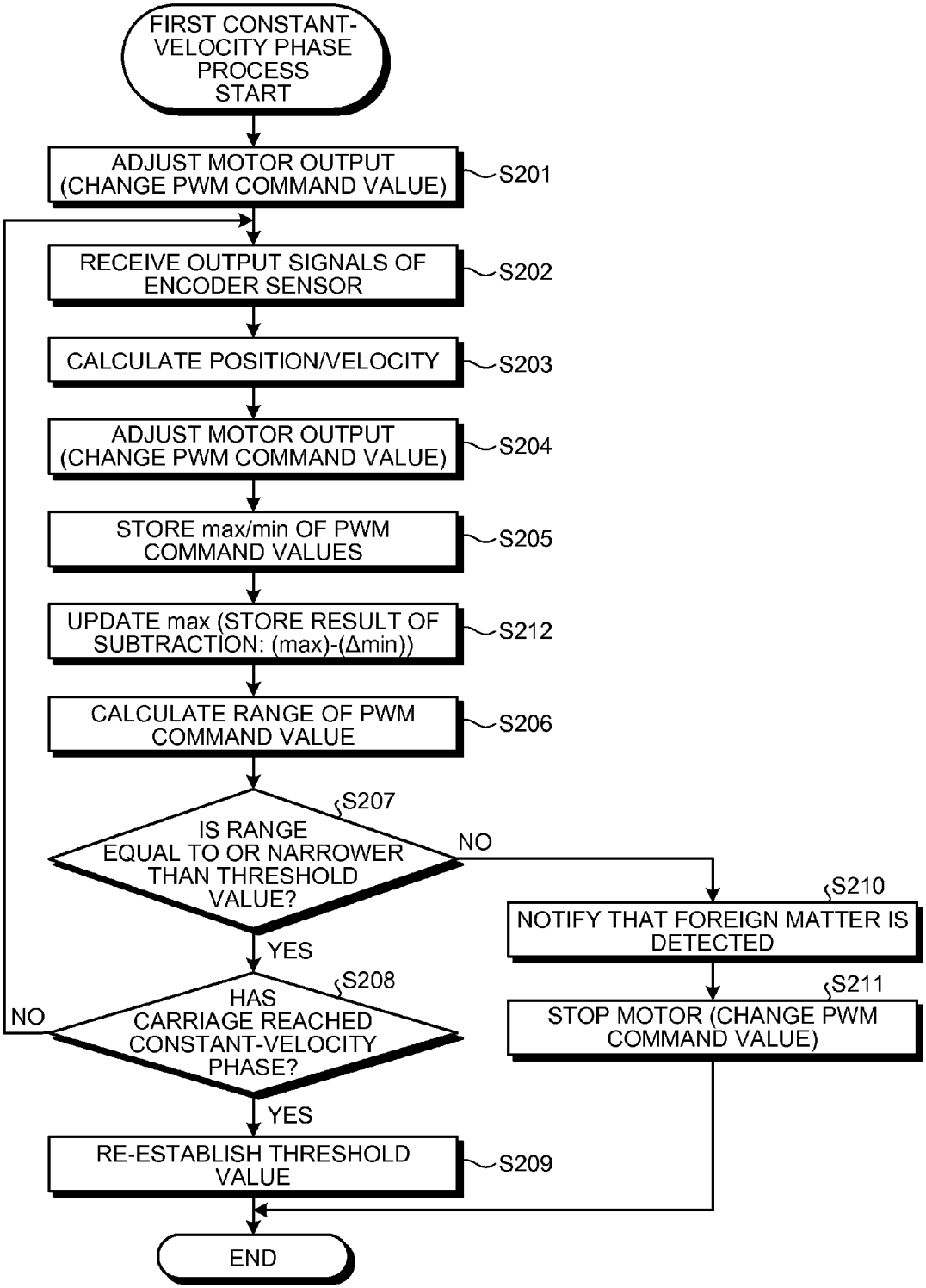
FIG. 18 is a flow diagram illustrating an example of the first constant-velocity phase process illustrated in FIG. 9 according to the third implementation example.

The first constant-velocity phase process illustrated in FIG. 9 according to the third implementation example is described below with reference to the flow diagram illustrated in FIG. 18.

As in the first constant-velocity phase process described above with reference to FIG. 11, in the first constant-velocity phase process according to the third implementation example, when the PWM command value is the maximum value max or the minimum value min in the constant-velocity phase, this value is stored and held in the memory (storing unit) (S205).

Thereafter, the change amount Δmin of the minimum value of the PWM command value is subtracted from the maximum value max, and a result of this subtraction is stored as the maximum value max (S212).

As in the first constant-velocity phase process described above with reference to FIG. 11, the range ΔPWM of the PWM command value is calculated from the stored maximum value max and the minimum value min of the PWM command value (S206).

The other procedure of the first constant-velocity phase process according to the third implementation example is similar to that described above with reference to FIG. 11, and repeated description is omitted.

Performing the first constant-velocity phase process as described above allows, in a situation where the range of the PWM command value is large, preventing false detection of a foreign matter that would otherwise occur at or near the minimum value of the range.

Figure 19:
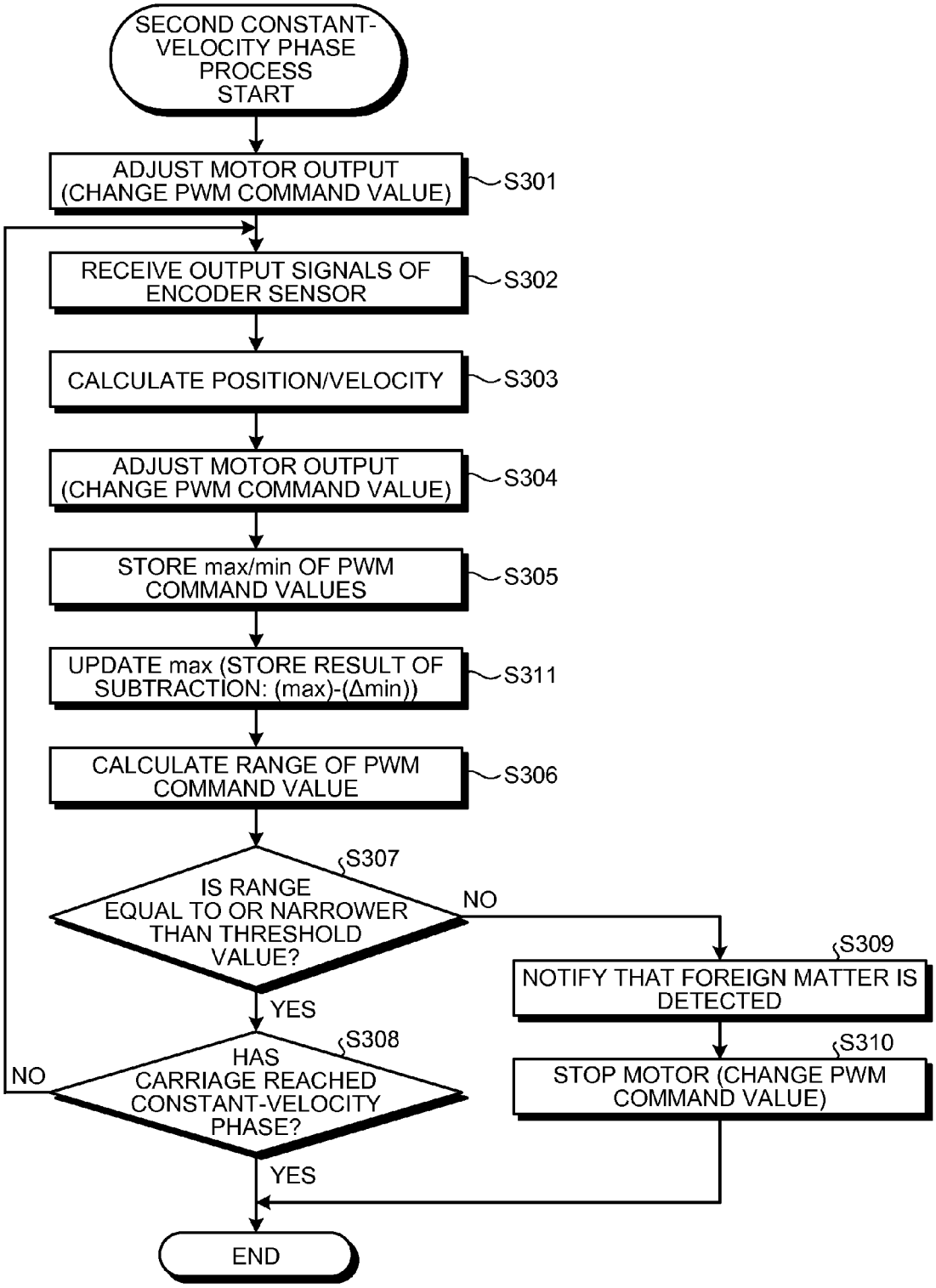
FIG. 19 is a flow diagram illustrating an example of the second constant-velocity phase process illustrated in FIG. 9 according to the third implementation example.

The second constant-velocity phase process illustrated in FIG. 9 according to the third implementation example is described below with reference to the flow diagram illustrated in FIG. 19.

As in the second constant-velocity phase process described above with reference to FIG. 12, in the second constant-velocity phase process according to the third implementation example, when the PWM command value is the maximum value max or the minimum value min in the constant-velocity phase, this value is stored and held in the memory (storing unit) (S305).

Thereafter, the change amount Δmin of the minimum value of the PWM command value is subtracted from the maximum value max, and a result of this subtraction is stored as the maximum value max (S311).

As in the second constant-velocity phase process described above with reference to FIG. 12, the range ΔPWM of the PWM command value is calculated from the stored maximum value max and the minimum value min of the PWM command value (S306).

The other procedure of the second constant-velocity phase process according to the third implementation example is similar to that described above with reference to FIG. 12, and repeated description is omitted.

Performing the second constant-velocity phase process as described above allows, in a situation where the range of the PWM command value is large, preventing false detection of a foreign matter that would otherwise occur at or near the minimum value of the range.

Processing related to control of the main-scanning motor of the embodiment is performed by a computer (CPU) by executing instructions stored in the ROM or the like. The instructions may be provided as being stored in a recording medium or by being downloaded over a network such as the Internet.

While the term "paper" is used herein, it should be understood that this term is not limited to paper in narrow sense. Rather, "paper" refers to any medium, to which ink droplets or other liquid or the like can stick, such as a transparency film, cloth, glass, or a substrate, and includes what is referred to as to-be-recorded media, recording media, recording paper, and recording sheets. The terms "image forming", "recording", "photo printing", and "printing" may be used as synonyms.

The term "image forming apparatus" as used herein refers to an apparatus that forms an image by ejecting liquid onto a medium of paper, yarn, fiber, woven cloth, leather, metal, plastic, glass, wood, ceramic, or the like. The term "image forming" as used herein refers to not only applying an image, such as a text or a graphic symbol, that carries some information on a medium, but also applying an image, such as a pattern, that carries no information on a medium (i.e., simply causing droplets to impact the medium).

The term "ink" as used herein is not limited to what is generally referred to as "ink" unless otherwise specified, and encompasses any types of liquid, such as recording liquid or fixing solution, with which an image can be formed. Examples of the "ink" include a DNA sample, a solder mask, a circuit-pattern forming material, and a resin.

The term "image" as used herein is not limited to a two-dimensional image, but includes an image applied on a three-dimensional surface and, furthermore, a solid object created by three-dimensional image forming.

While the embodiment is applied to the image forming apparatus that uses roll paper, the embodiment is applicable as well to an image forming apparatus that uses sheets of paper.

According to an aspect of the embodiment, it is possible to immediately detect contact between a carriage that is moving and paper or a foreign matter and, upon detection, stop the carriage.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a carriage including a recording head mounted thereon, the carriage being to be driven by a driving source to reciprocate; and a drive control unit that controls driving of the driving source by PWM control, wherein the drive control unit comprises:

a detecting unit that detects at least any one of a position and a velocity of the carriage;

a calculating unit that calculates PWM command values from detection results output from the detecting unit;

a storing unit that stores a maximum value and a minimum value of the PWM command values calculated by the calculating unit;

a comparing unit that compares a difference between the maximum value and the minimum value of the PWM command values against a predetermined threshold value; and a stop-output command unit that, when a result of comparison made by the comparing unit is that the difference between the maximum value and the minimum value of the PWM command values exceeds the threshold value, outputs a command to stop driving of the carriage.

2. The image forming apparatus according to claim 1, further comprising a unit that, when the stored minimum value of the PWM command value is to be changed from the pre-change minimum value to a post-change minimum value, obtains a result of subtracting a difference between the pre-change minimum value of the PWM command value and the post-change minimum value of the PWM command value from the stored maximum value of the PWM command value, and overwrites the maximum value of the PWM command value with the result.

3. The image forming apparatus according to claim 1, wherein the detecting unit includes a linear encoder, and a generating unit that generates a position signal and a velocity signal from output signals of the linear encoder.

4. The image forming apparatus according to claim 1, wherein the drive control unit performs re-establishment of the threshold value at regular time intervals.

5. The image forming apparatus according to claim 4, wherein the re-establishment of the threshold value is performed when an operation of moving the carriage is performed for the first time after power-on.

6. The image forming apparatus according to claim 4, wherein the image forming apparatus has an energy saving mode where power supply to at least a portion of the apparatus is stopped, and the re-establishment of the threshold value is performed when an operation of moving the carriage is performed for the first time after exiting the energy saving mode.

7. The image forming apparatus according to claim 4, further comprising a unit that outputs a count of number of printed sheets, wherein the re-establishment of the threshold value is performed when the count of the printed sheets reaches a predetermined number of sheets.

8. The image forming apparatus according to claim 4, further comprising a unit that outputs a count of number of moves made by the carriage, wherein the re-establishment of the threshold value is performed when the count of the moves reaches a predetermined number.

9. The image forming apparatus according to claim 4, further comprising:

a unit that detects at least any one of an ambient temperature and an ambient humidity of the apparatus; and a unit that determines whether or not at least any one of an amount of change in the ambient temperature of the apparatus and an amount of change in the ambient humidity of the apparatus has exceeded a predetermined amount of change, wherein the re-establishment of the threshold value is performed when the amount of change, on which determination has been made, exceeds the predetermined amount of change.

10. The image forming apparatus according to claim 4, wherein the carriage is caused to move at a maximum velocity when the re-establishment of the threshold value is performed.

11. An image forming method for forming an image by controlling driving of a driving source of a carriage by PWM control, the carriage including a recording head mounted thereon and being to be driven to reciprocate by the driving source, the image forming method comprising:

detecting at least any one of a position and a velocity of the carriage;

calculating PWM command values from results of the detecting;

storing a maximum value and a minimum value of the calculated PWM command values;

comparing a difference between the maximum value and the minimum value of the PWM command values against a predetermined threshold value; and outputting a command to stop driving of the carriage when a result of the comparing is that the difference between the maximum value and the minimum value of the PWM command values exceeds the threshold value.

12. A non-transitory computer-readable storage medium having computer readable program codes, performed by an image forming apparatus that includes a carriage including a recording head mounted thereon, the carriage being to be driven by a driving source to reciprocate and a drive control unit that controls driving of the driving source by PWM control, the program codes when executed causing the image forming apparatus to execute:

detecting at least any one of a position and a velocity of the carriage;

calculating PWM command values from results of the detecting;

storing a maximum value and a minimum value of the calculated PWM command values;

comparing a difference between the maximum value and the minimum value of the PWM command values against a predetermined threshold value; and outputting a command to stop driving of the carriage when a result of the comparing is that the difference between the maximum value and the minimum value of the PWM command values exceeds the threshold value.

* * * * *